US008783358B2

(12) United States Patent
Critsinelis et al.

(10) Patent No.: US 8,783,358 B2
(45) Date of Patent: Jul. 22, 2014

(54) METHODS AND SYSTEMS FOR CIRCULATING FLUID WITHIN THE ANNULUS OF A FLEXIBLE PIPE RISER

(75) Inventors: Antonio C. F. Critsinelis, Kingwood, TX (US); Christopher A. Kassner, Houston, TX (US); Farzan Parsinejad, Houston, TX (US); Ahmed Omar, Katy, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 483 days.

(21) Appl. No.: 13/234,255

(22) Filed: Sep. 16, 2011

(65) Prior Publication Data

US 2013/0068465 A1 Mar. 21, 2013

(51) Int. Cl.

| | |
|---|---|
| ***E21B 7/12*** | (2006.01) |
| ***E21B 17/01*** | (2006.01) |
| ***E21B 17/18*** | (2006.01) |
| ***E21B 17/02*** | (2006.01) |

(52) U.S. Cl.

CPC ..... *E21B 17/01* (2013.01); *E21B 17/18* (2013.01); *E21B 17/025* (2013.01)

USPC ..... 166/344; 166/346; 166/367

(58) Field of Classification Search

CPC ..... E21B 17/015; E21B 17/18; E21B 17/20

USPC ..... 166/344, 346, 367; 405/224.3

See application file for complete search history.

(56) References Cited

U.S. PATENT DOCUMENTS

| | | | | |
|---|---|---|---|---|
| 4,291,772 | A * | 9/1981 | Beynet | 175/5 |
| 4,665,983 | A * | 5/1987 | Ringgenberg | 166/264 |
| 6,142,236 | A | 11/2000 | Brammer et al. | |
| 6,253,855 | B1 | 7/2001 | Johal et al. | |
| 6,527,053 | B2 * | 3/2003 | Friisk | 166/346 |
| 6,601,600 | B1 * | 8/2003 | Taylor | 137/15.04 |

(Continued)

FOREIGN PATENT DOCUMENTS

| | | |
|---|---|---|
| EP | 1608904 | 10/2004 |
| EP | 1492936 | 1/2006 |
| WO | 2010067092 | 6/2010 |
| WO | 2010084035 | 7/2010 |

OTHER PUBLICATIONS

Developments in Managing Flexible Risers and Pipelines, a Suppliers Perspective, C.S. Dahl, B. Andersen and M. Groenne, Offshore Technology Conference, May 2011.

(Continued)

*Primary Examiner* — Matthew Buck
*Assistant Examiner* — Aaron Lembo
(74) *Attorney, Agent, or Firm* — Karen R. DiDomenicis; Melissa Patangia

(57) ABSTRACT

Disclosed is a process and system for circulating fluid within the annulus of a flexible pipe used in a riser in an offshore hydrocarbon production facility. Fluid, such as corrosion inhibitors, can be circulated in a closed loop which includes the annulus of the riser terminating at a platform or floating vessel, a fluid storage tank located on the platform or vessel and an umbilical tube terminating at the platform or vessel and at a subsea location. Use of the system to flow the fluid through the annulus can prevent or reduce corrosion of the steel members within the annulus and increase the fatigue life of the riser.

14 Claims, 7 Drawing Sheets

(56) References Cited

U.S. PATENT DOCUMENTS

| | | | | |
|---|---|---|---|---|
| 7,650,944 | B1 * | 1/2010 | Boyle | 166/344 |
| 7,677,329 | B2 * | 3/2010 | Stave | 175/5 |
| 8,256,532 | B2 * | 9/2012 | Gray | 175/48 |
| 8,517,111 | B2 * | 8/2013 | Mix et al. | 166/363 |
| 8,651,185 | B2 * | 2/2014 | Hermes | 166/286 |
| 2003/0170077 | A1 * | 9/2003 | Herd et al. | 405/224.2 |
| 2004/0065440 | A1 * | 4/2004 | Farabee et al. | 166/358 |
| 2004/0076478 | A1 | 4/2004 | Legras et al. | |
| 2010/0018693 | A1 * | 1/2010 | Duncan et al. | 166/77.2 |
| 2010/0108321 | A1 | 5/2010 | Hall et al. | |
| 2011/0026031 | A1 | 2/2011 | Kristiansen et al. | |
| 2011/0153225 | A1 | 6/2011 | Mangal et al. | |
| 2011/0297388 | A1 * | 12/2011 | Stave | 166/345 |
| 2013/0269947 | A1 * | 10/2013 | Shilling et al. | 166/345 |

OTHER PUBLICATIONS

On the Beneficial Influence of a Very Low Supply of H2S on the Hydrogen Embrittlement Resistance of Carbon Steel Wires in Flexible Pipe Annulus, N. Desamais and C. Taravel-Condat, Offshore Technology Conference, May 2009.

Development and Testing of Non-Bonded Flexible Pipe for High Temperature/High Pressure/Deepwater/Dynamic Sour Service Applications, Mark Kalman, John Belcher, Bin Chen, Dana Fraser, Andrew Ethridge, Cobie Loper, Offshore Technology Conference, May 1996.

MOLDI™: A Fluid Permeation Model to Calculate the Annulus Composition in Flexible Pipes: Validation with Medium Scale Tests, Full Scale Tests and Field Cases, C. Taravel-Condat, M. Guichard, J. Martin, Proceedings of OMAE03, 22nd International Conference on Offshore Mechanics and Arctic Engineering, Jun. 2003.

Offshore Pipeline and Riser Integrity—The Big Issues, Jonathan Marsh, Phil Duncan, Ian MacLeod, Society of Petroleum Engineers, Sep. 2009.

Comparison of Models to Predict the Annulus Conditions of Flexible Pipe, S. Last, S. Groves, J. Rigaud, C. Taravel-Condat, J. Wedel-Heinen, R. Clements, S. Buchner, Offshore Technology Conference, May 2002.

* cited by examiner

METHODS AND SYSTEMS FOR CIRCULATING FLUID WITHIN THE ANNULUS OF A FLEXIBLE PIPE RISER

FIELD

The disclosure relates to methods and systems for operating a riser in an offshore hydrocarbon production facility, the riser being formed of flexible pipe having a central bore and an annulus containing multiple functional layers. More particularly, the disclosure relates to methods and systems for circulating fluids in the annulus of a flexible pipe riser.

BACKGROUND

Engineered flexible pipe is frequently used in riser applications in offshore hydrocarbon production facilities which convey hydrocarbon products from a subsea well to a topsides production platform or vessel. Such flexible pipe is formed of multiple layers, each layer designed for a specific function. In general, the innermost layer of the multiple layers is the carcass layer, made of corrosion resistant material, designed to resist collapse of the flexible pipe. Surrounding the carcass is a polymeric sealant layer or pressure sheath which is extruded around the carcass and sealed at flexible pipe end fittings to contain fluid within the bore. Surrounding the polymeric sealant layer is an annulus containing a number of metallic armor layers designed to impart strength against tensile loading (e.g. armor wires) and internal pressure loading (e.g. pressure armor). Surrounding these layers is another polymeric sealant layer or external sheath designed to avoid external sea water ingress into inner layers of the flexible pipe, which acts as an outer protective layer. The space between the two polymeric sealant layers is referred to as "the annulus." Typically, the annulus contains one or two layers of circumferentially oriented steel members (referred to as pressure armor layers) designed to provide radial strength and burst resistance due to internal pressure. Surrounding the pressure armor layers are two or four layers of helically wound armor wires (referred to as armor wire layers) designed to provide tensile strength in the axial direction.

Flexible pipe is terminated at each end by an end fitting which incorporates a flange for mating with other flanges. In use, flexible pipe risers are suspended from an offshore hydrocarbon production platform or host facility, thus placing high tensile loads on the armor wire layers. The loads along the riser are amplified due to the effects of environmental conditions and associated motions of the platform or host facility to which the riser is connected.

Within the bore of the flexible pipe, in addition to hydrocarbon products, other components including hydrogen sulfide, carbon dioxide and water may be present. These other components can diffuse through the first polymeric sealant layer (pressure sheath) to the annulus. These components, hydrogen sulfide in particular, as well as water vapor, can accumulate within the annulus and eventually lead to corrosion of the steel wires therein via mechanisms including hydrogen induced cracking and sulfide stress cracking. Additionally, the annulus can be flooded with seawater due to damage of the outermost layer leading to corrosion of the armor wires. As noted, the armor wires in the flexible riser are particularly subject to dynamic cyclic loads, which can result in corrosion fatigue of the metallic armor wires in the annulus. Corrosion of the metallic wires in this region makes these wires particularly vulnerable to corrosion fatigue and potential acceleration of failure mechanism.

It would be desirable to provide a way to prevent or reduce corrosion of the armor wires and other steel elements within the annulus of flexible pipe used in risers and in other dynamic applications.

SUMMARY

According to one embodiment, a method is provided for circulating fluid within the annulus of a flexible pipe riser in an offshore hydrocarbon production facility. The method includes pumping the fluid into a closed loop at sufficient pressure to cause fluid to circulate through the loop. The loop includes the annulus of a flexible pipe riser terminating at a topsides riser end fitting at a production platform or an offshore vessel and at a subsea riser end fitting at a subsea location, and at least one umbilical tube within a subsea umbilical in fluid communication with the subsea riser end fitting, and terminating at an umbilical end fitting at the platform or vessel in fluid communication with the annulus.

In another embodiment, a system is provided for use in an offshore hydrocarbon production facility. The system includes at least one subsea umbilical tube terminating at a production platform or offshore vessel and at a subsea location for conveying a fluid; at least one flexible pipe riser terminating at a production platform or offshore vessel and at a subsea location, wherein the flexible pipe riser includes an annulus in fluid communication with the at least one umbilical tube; end fittings at each terminal location of the flexible pipe riser, wherein each end fitting comprises a port in fluid communication with the annulus; a connector for placing the at least one umbilical tube in fluid communication with the port of the end fitting at the subsea location; and a pump for pumping fluid to circulate the fluid within a closed loop comprising the annulus and the at least one umbilical tube.

In yet another embodiment, a method for retrofitting a riser system in an existing offshore hydrocarbon production facility is provided. The method includes disconnecting from a topsides venting system a port of an existing topsides end fitting of a flexible pipe riser including an annulus, wherein the flexible pipe riser has a topsides end fitting and a subsea end fitting having a venting port check valve in fluid communication with the annulus; and removing the venting port check valve from the subsea end fitting. The method further includes providing a recirculation kit on the production platform or offshore vessel, the recirculation kit including a fluid storage tank having a tank inlet and a tank outlet; a pump having a pump inlet in fluid communication with the tank outlet and a pump outlet; and piping for fluid connection between the tank outlet and the pump inlet. The port of the flexible pipe riser topsides end fitting is connected to the recirculation kit. A subsea end of an umbilical tube is connected to a port in the subsea end fitting of the flexible pipe riser. Finally, a topsides end of the umbilical tube is connected to the recirculation kit thereby establishing a closed loop including the annulus, the umbilical tube and the recirculation kit.

DESCRIPTION OF THE DRAWINGS

These and other objects, features and advantages of the present invention will become better understood with regard to the following description, appended claims and accompanying drawings where:

FIGS. 1A-1I illustrate systems for circulating fluid within the annulus of a flexible pipe riser in an offshore hydrocarbon production facility.

DETAILED DESCRIPTION

Figure 1B:
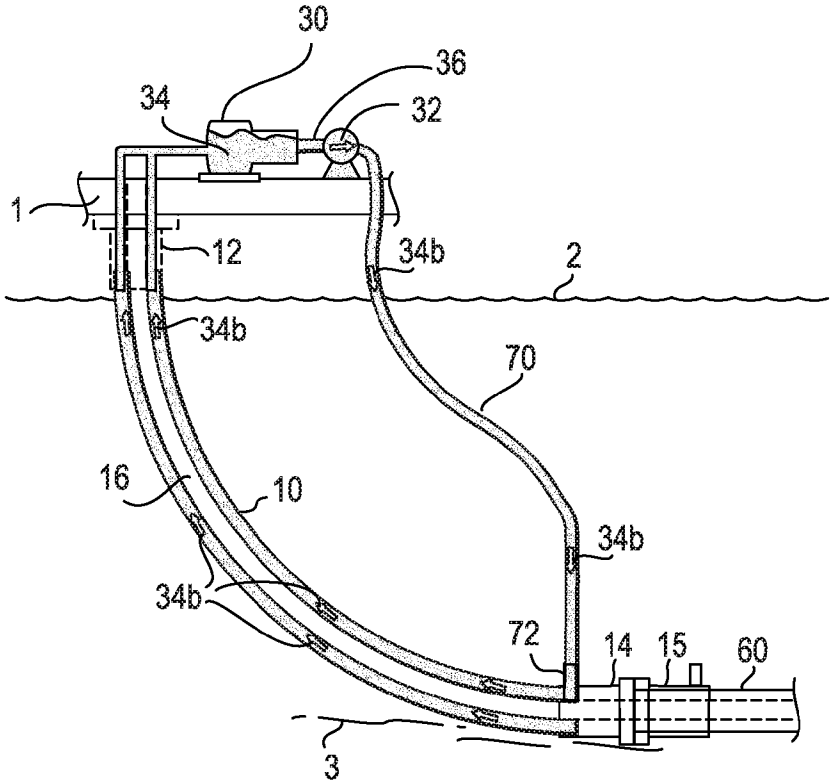

According to methods and systems of the present disclosure, the incidence of corrosion over time of armor wires and other steel elements (e.g. pressure armor layer(s)) within the annulus of flexible pipe, such as those used in flexible pipe risers in offshore hydrocarbon production facilities, can be reduced.

The incidence of corrosion of the armor wires and related problems such as corrosion fatigue can be reduced by circulating a corrosion-inhibiting or a fluid containing surface passivating agents or other additives within the annulus so that the fluid flows in the interstices between the armor wires and other steel elements. A gas-flushing fluid to flush $H_2S$, $CO_2$, water vapor, etc. from the annulus can also be used. The fluid is referred to interchangeably herein as "buffer fluid," "flushing fluid," or simply "fluid." The fluid can be circulated either continuously or intermittently. The fluid contacts and encompasses the armor wires and other steel elements, protecting them from corrosion. In another embodiment of the present disclosure, rather than or in addition to buffer fluid, image sensitive-materials can be circulated within the annulus of the flexible pipe riser, thus allowing the annulus to be imaged using known techniques.

The buffer fluid is circulated in a closed loop which includes the annulus of the flexible pipe riser and at least one umbilical tube within a subsea umbilical. Referring to FIG. 1A, a system is illustrated according to one embodiment in which a production platform 1 is connected to a flexible pipe riser 10 (at topsides end fitting 12). The flexible pipe riser 10 terminates on the seabed 3 at a touchdown point where end fitting 14 rests on the seabed 3. End fitting 14 is connected to an end fitting 15 of a flow line 60. Buffer fluid 34 is stored in fluid storage tank 30 on the production platform 1. The fluid 34 is taken from the tank 30, through conduit 36 and pumped by pump 32 into the annulus of flexible pipe riser 10. Subsea umbilical 70 is connected to the flexible pipe riser end fitting 14 at port 72. Fluid pressure drives the fluid 34 to rise through umbilical 70 to return to the tank 30 on the platform 1. Arrows 34*a* indicate the direction of flow of the buffer fluid within the closed loop.

Figure 1A:
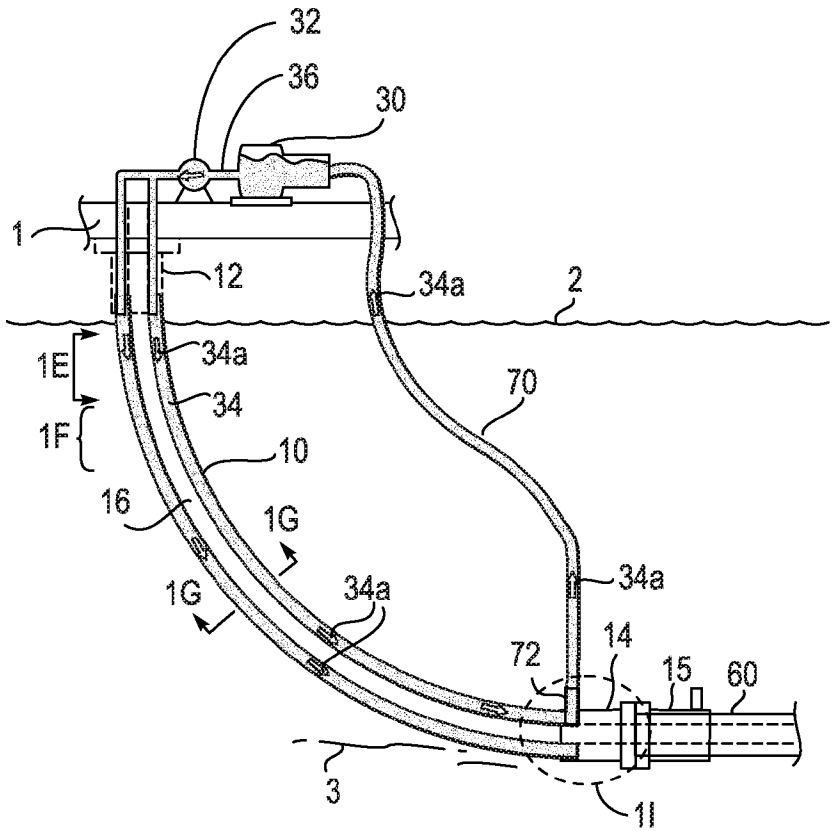
Figure 1C:
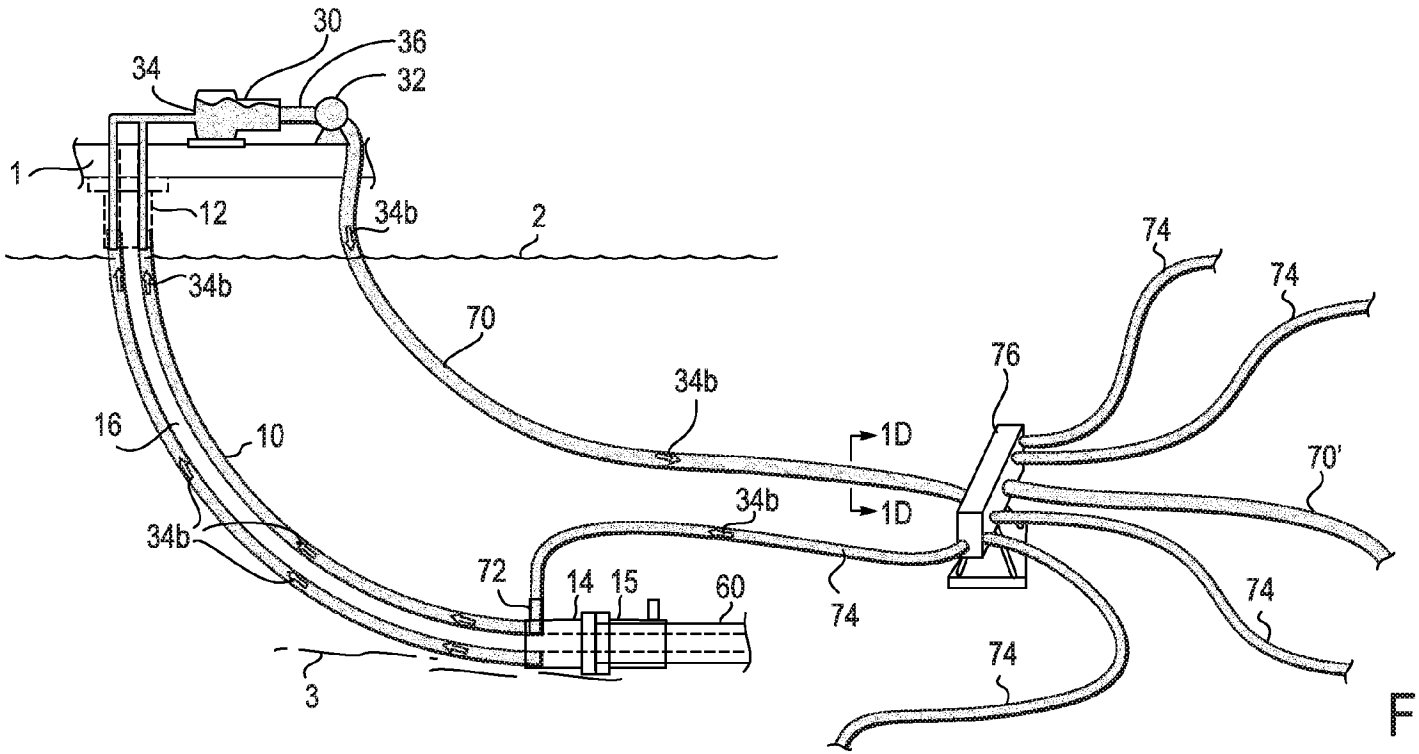
Figure 1D:
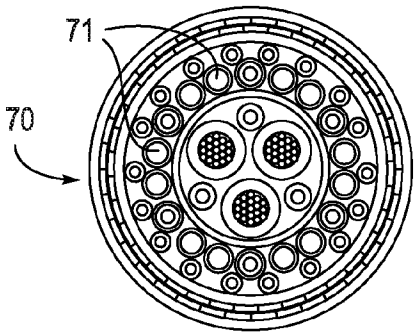
Figure 1E:
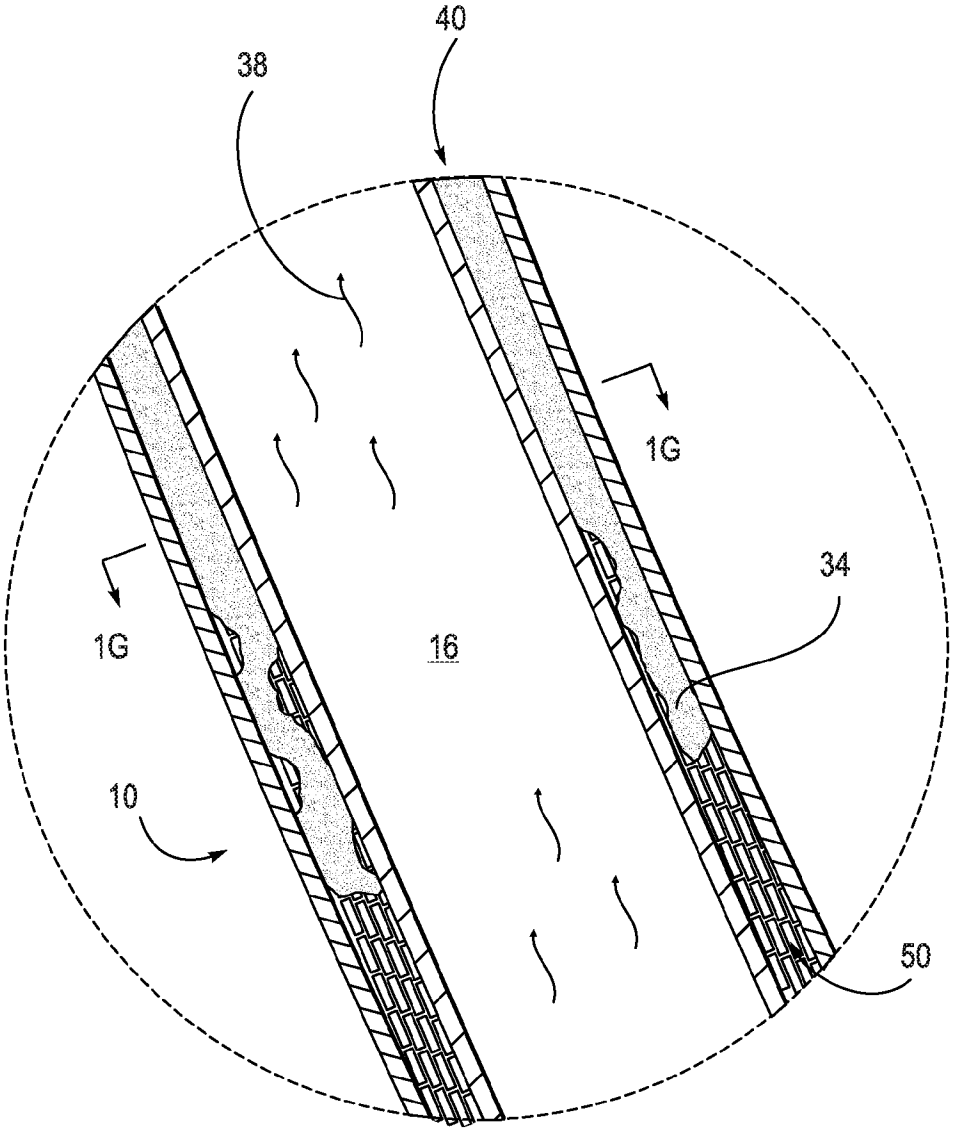
Figure 1G:
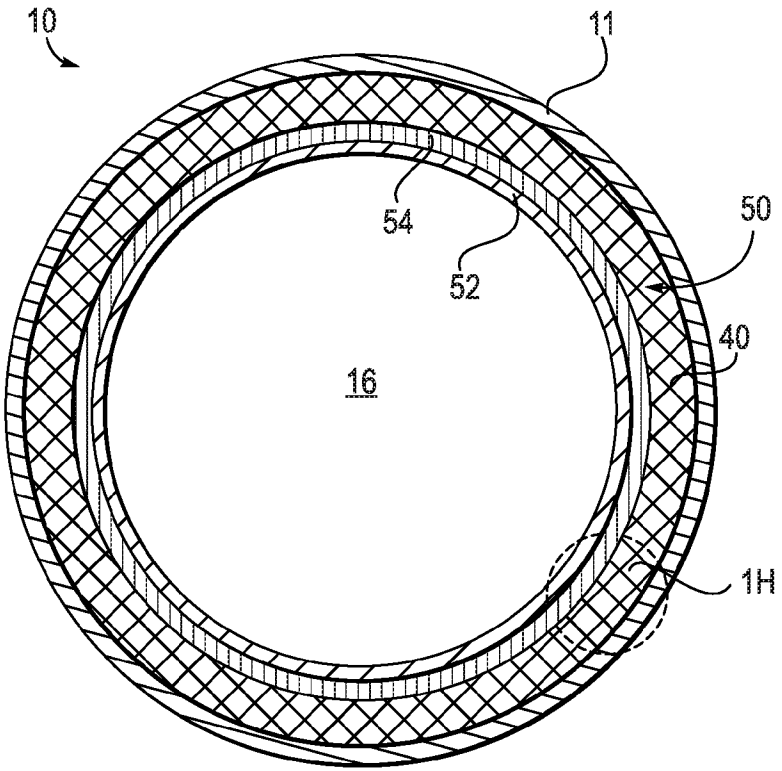
Figure 1F:
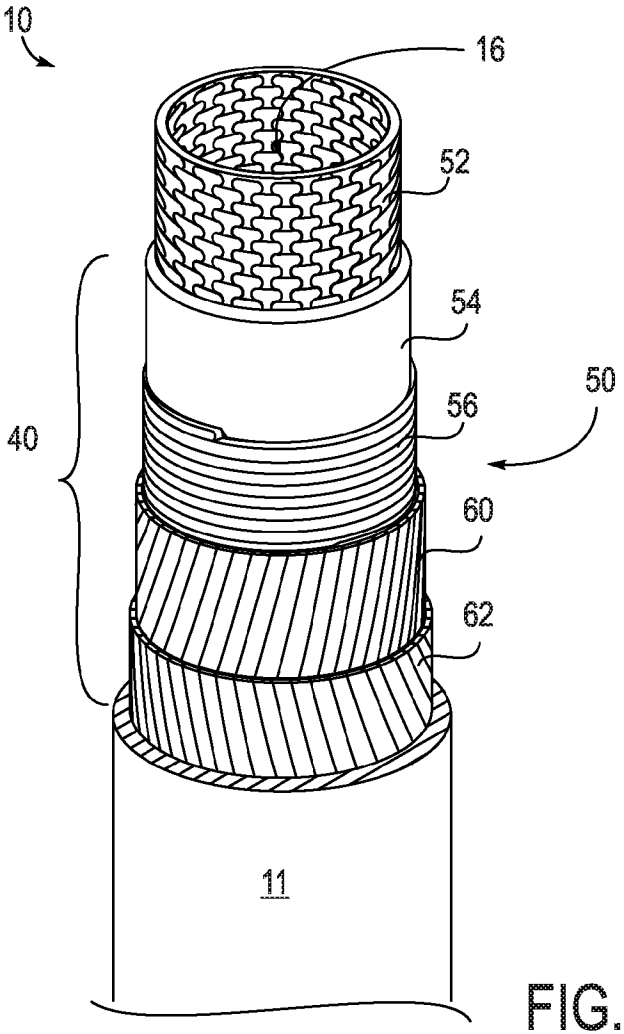
Figure 1H:
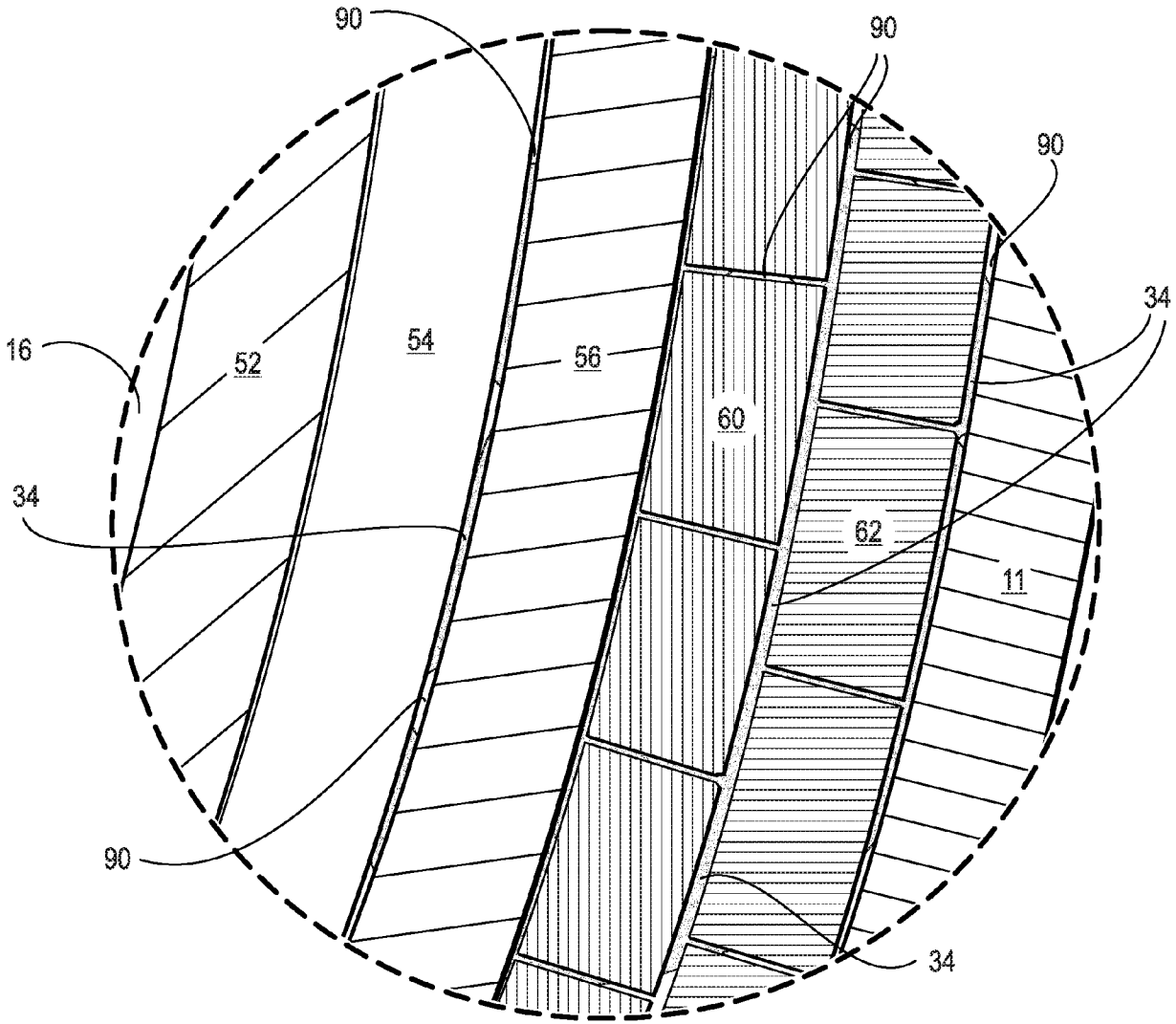
Figure 11:
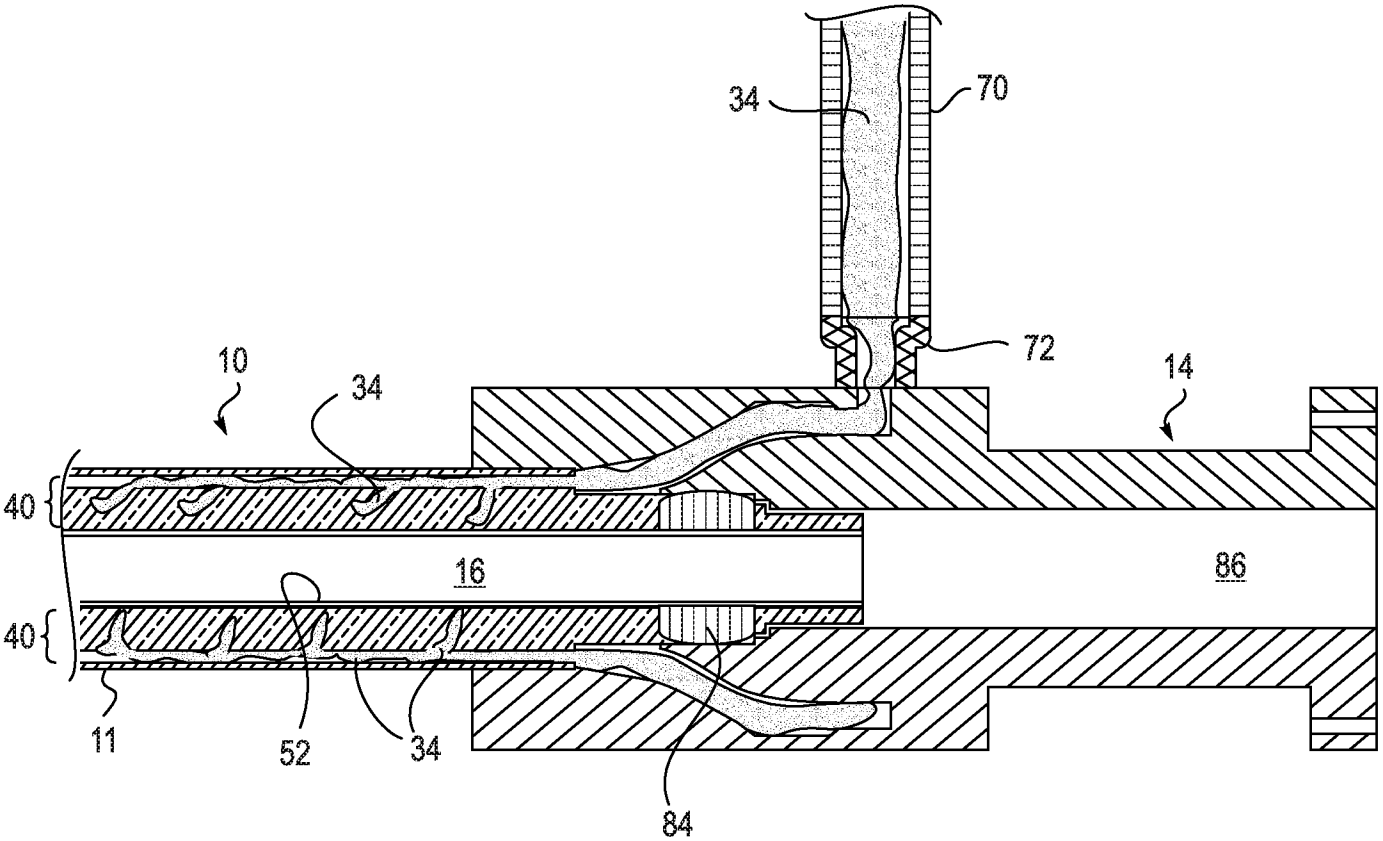

FIG. 1E is a longitudinal cross-section of the flexible pipe riser 10 illustrating a side view of the annulus 40 surrounding bore 16 having produced well fluids containing hydrocarbons 38 flowing there through. The armor wires and other steel elements within the annulus are represented by 50. FIG. 1F is an exploded view of flexible pipe riser 10 showing each of the layers of the flexible pipe. Innermost is the bore 16 within the carcass 52. The carcass 52 is surrounded by pressure sheath 54 which is in turn surrounded by the annulus 40. The annulus 40 which includes layers 50, including pressure armor layer 56, inner tensile armor wire layer 60 and outer tensile armor wire layer 62. Surrounding the outer tensile armor wire layer is the external sheath 11. The cross-section of the flexible pipe is shown in FIG. 1G. FIG. 1H is an expanded view of the wall of the flexible pipe, showing each of the layers previously described as well as the interstitial spaces 90 there between. Within these spaces, buffer fluid 34 flows.

FIG. 1I illustrates the subsea end fitting 14 of the flexible pipe riser 10 according to one embodiment. As shown in this embodiment, flexible pipe riser 10 is attached to end fitting 14 by bolts 84. The end fitting 14, including bore 86 therein, is designed to securely attach to the end of the flexible pipe and allow for attachment to an adjacent fitting. End fitting 14 also includes a port 72 in fluid communication with the annulus 40 of flexible pipe riser 10. The umbilical 70 can be connected to port 72 which can be the location of a venting valve in a typical end fitting, thereby providing fluid communication between the umbilical 70 and the annulus 40. While the figure shows 70 as a single umbilical tube, it should be understood that fluid 34 can flow through one or more individual umbilical tubes within a multicomponent subsea umbilical.

FIG. 1B illustrates an alternative embodiment similar to that of FIG. 1A in which the direction of buffer fluid flow in the closed loop, as indicated by 34*b*, is reversed. In this embodiment, the fluid 34 is pumped from the storage tank 30, through conduit 36 and pump 32 into at least one umbilical tube within a subsea umbilical 70. As described above, umbilical 70 is connected via port 72 to flexible pipe riser end fitting 14, such that fluid 34 passes from the umbilical 70 to the annulus 40 of the flexible pipe 10. Fluid pressure drives the fluid 34 to rise through the annulus 40 to return to the tank 30 on the platform 1.

Figure 2:
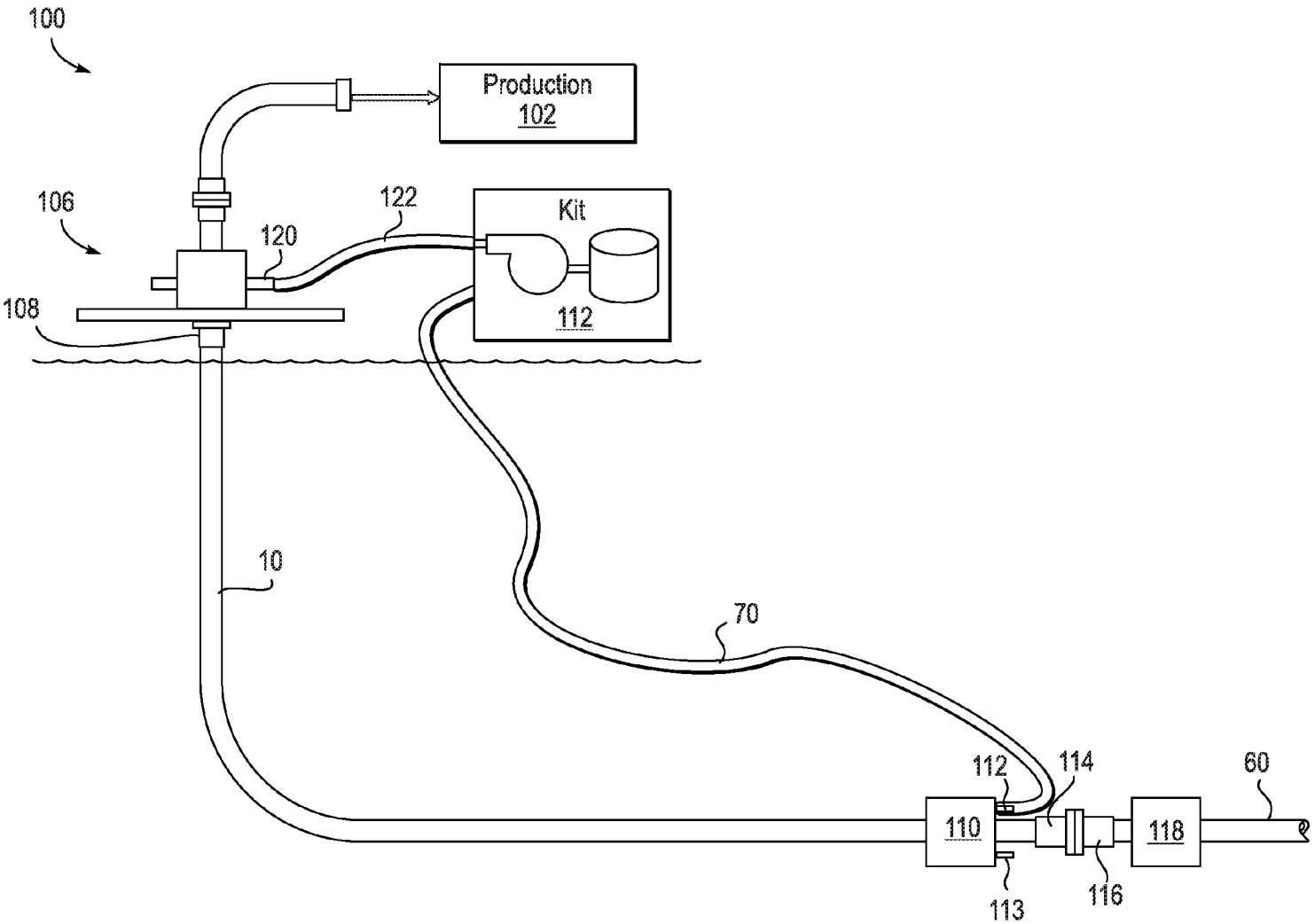
FIG. 2 illustrates a method for retrofitting a riser system in an existing offshore hydrocarbon production facility.

FIG. 1 illustrates an alternative embodiment similar to that of FIG. 1A in which fluid 34 flows through one or more individual umbilical tubes within a multicomponent subsea umbilical 70. FIG. 1D shows the multicomponent subsea umbilical 70 in cross-section. Among the components within the umbilical 70 are individual umbilical tubes 71 through which fluid 34 flows. As shown in FIG. 1C, fluid 34 is pumped into umbilical 70 via individual umbilical tubes 71. Umbilical 70 terminates at a distribution unit 76 which can be any suitable manifold structure such as an umbilical terminal assembly (UTA). From the distribution unit 76, a second umbilical 70' can carry controls to various systems or equipment in the hydrocarbon production facility. One or more flying leads 74 can be used to transmit fluid 34 to flexible pipe riser end fittings 14 (other flexible pipe riser end fittings not shown). In this way, buffer fluid 34 can be circulated through multiple risers within a single hydrocarbon production facility. FIG. 2 illustrates a method for retrofitting an existing riser system according to one embodiment. In an existing offshore hydrocarbon production facility 100, a topsides structure 106 mounted on a platform receives produced well fluids from flexible pipe riser 10, connected at 108, and sends the well fluids for further processing indicated by Production 102. Port 120 on topsides end fitting of riser 10 is typically connected to a venting system (not shown) for venting gases from the annulus of the flexible pipe riser 10. At a subsea location, riser 10 terminates at subsea riser end fitting 110 where connection is established with flow line 60. Flanges 114 and 116 connect subsea riser end fitting 110 to subsea flow line end fitting 118. Subsea riser end fitting 110 typically has one or more venting port check valve(s) 113 which are in fluid communication with the annulus of the flexible pipe 10.

In order to retrofit the existing system, one of the venting port check valves 113 is removed from the subsea riser end fitting 110 and an umbilical 70 is connected to the port in its place. Port 120 on topsides end fitting of riser 10 is disconnected from the venting system (not shown). A recirculation kit 112 containing a fluid storage tank and pump are provided at the platform. The kit is connected to the port 120 (via line 122 as shown) and to the umbilical 70 thus establishing a closed loop including the annulus of the flexible pipe riser 10, the umbilical 70 and the recirculation kit 112 through which fluid can be circulated. The kit can be connected so that the port of the flexible pipe riser topsides end fitting is connected to the pump outlet and the topsides end of the umbilical tube is connected to the tank inlet. Alternatively, the kit can be connected so that the port of the flexible pipe riser topsides end fitting is connected to the tank inlet and the topsides end of the umbilical tube is connected to the pump outlet.

Where permitted, all publications, patents and patent applications cited in this application are herein incorporated by reference in their entirety, to the extent such disclosure is not inconsistent with the present invention.

Unless otherwise specified, the recitation of a genus of elements, materials or other components, from which an individual component or mixture of components can be selected, is intended to include all possible sub-generic combinations of the listed components and mixtures thereof. Also, "comprise," "include" and its variants, are intended to be non-limiting, such that recitation of items in a list is not to the exclusion of other like items that may also be useful in the materials, compositions, methods and systems of this invention.

From the above description and appended drawings, those skilled in the art will perceive improvements, changes and modifications, which are intended to be covered by the appended claims.

What is claimed is:

1. A method for circulating fluid within an annulus of a flexible pipe riser in an offshore hydrocarbon production facility, comprising:

pumping a fluid into a closed loop at sufficient pressure to cause fluid to circulate through the closed loop, wherein the closed loop comprises:

an annulus of a flexible pipe riser terminating at a topsides riser end fitting at a production platform or an offshore vessel and at a subsea riser end fitting at a subsea location, and at least one umbilical tube within a subsea umbilical in fluid communication with the subsea riser end fitting, and terminating at an umbilical end fitting at the platform or vessel in fluid communication with the annulus of the flexible pipe riser.

2. The method of claim 1, wherein the closed loop further comprises a fluid storage tank for storing the fluid, the fluid storage tank being located on the platform or vessel in fluid communication with the annulus and the at least one umbilical tube.

3. The method of claim 1, wherein the at least one umbilical tube is connected to the subsea riser end fitting.

4. The method of claim 1, wherein the fluid is pumped into the topsides riser end fitting through a port in fluid communication with the annulus, and returned to the production platform or offshore vessel through the at least one umbilical tube.

5. The method of claim 4, wherein the closed loop further comprises a flying lead between and in fluid communication with the at least one umbilical tube and a port in the subsea riser end fitting.

6. The method of claim 5, wherein the closed loop further comprises a distribution unit connected to the at least one umbilical tube at a subsea location and connected to the flying lead, the distribution unit comprising multiple connection fittings for connecting multiple flying leads.

7. The method of claim 6, wherein multiple flying leads are connected to the multiple connection fittings of the distribution unit, and each flying lead is connected to a subsea riser end fitting at a subsea location.

8. The method of claim 1, wherein the fluid is pumped into at least one umbilical tube in fluid communication with a port in the subsea riser end fitting and returned through the annulus to the production platform or offshore vessel.

9. A system for use in an offshore hydrocarbon production facility, comprising:

a. at least one subsea umbilical tube terminating at a production platform or offshore vessel and at a subsea location for conveying a fluid;

b. at least one flexible pipe riser terminating at the production platform or offshore vessel and at the subsea location, wherein the flexible pipe riser includes an annulus in fluid communication with the at least one umbilical tube;

c. end fittings at each terminal location of the flexible pipe riser, wherein each end fitting comprises a port in fluid communication with the annulus;

d. a connector for placing the at least one umbilical tube in fluid communication with the port of the end fitting at the subsea location; and e. a pump for pumping fluid to circulate the fluid within a closed loop comprising the annulus and the at least one umbilical tube.

10. The system of claim 9, further comprising a fluid storage tank for storing the fluid, the fluid storage tank being located on the platform or vessel in fluid communication with the annulus and the least one umbilical tube.

11. The system of claim 9, wherein the connector is selected from a venting valve, a flying lead, a hydraulic connector and a hot stab.

12. A method for retrofitting a riser system in an existing offshore hydrocarbon production facility, comprising:

a. disconnecting from a topsides venting system a port of an existing topsides end fitting of a flexible pipe riser including an annulus, wherein the flexible pipe riser has a topsides end fitting and a subsea end fitting having a venting port check valve in fluid communication with the annulus;

b. removing the venting port check valve from the subsea end fitting;

c. providing a recirculation kit on the production platform or offshore vessel, the recirculation kit comprising:

i. a fluid storage tank having a tank inlet and a tank outlet;

ii. a pump having a pump inlet in fluid communication with the tank outlet and a pump outlet; and iii. piping for fluid connection between the tank outlet and the pump inlet;

d. connecting the port of the flexible pipe riser topsides end fitting to the recirculation kit;

e. connecting a subsea end of an umbilical tube to a port in the subsea end fitting of the flexible pipe riser; and f. connecting a topsides end of the umbilical tube to the recirculation kit thereby establishing a closed loop including the annulus, the umbilical tube and the recirculation kit.

13. The method of claim 12, wherein in step (d), the port of the flexible pipe riser topsides end fitting is connected to the pump outlet and in step (f), the topsides end of the umbilical tube is connected to the tank inlet.

14. The method of claim 12, wherein in step (d), the port of the flexible pipe riser topsides end fitting is connected to the tank inlet and in step (f), the topsides end of the umbilical tube is connected to the pump outlet.

* * * * *